US009666054B2

(12) United States Patent
Matko

(10) Patent No.: US 9,666,054 B2
(45) Date of Patent: May 30, 2017

(54) ALERT SYSTEM FOR CHILDREN WITHIN PROXIMITY OF A POOL OR WATER

(71) Applicant: Michelle Anna Matko, Tampa, FL (US)

(72) Inventor: Michelle Anna Matko, Tampa, FL (US)

( * ) Notice: Subject to any disclaimer, the term of this patent is extended or adjusted under 35 U.S.C. 154(b) by 0 days.

(21) Appl. No.: 14/796,331

(22) Filed: Jul. 10, 2015

(65) Prior Publication Data

US 2016/0012700 A1 Jan. 14, 2016

Related U.S. Application Data

(60) Provisional application No. 62/023,371, filed on Jul. 11, 2014.

(51) Int. Cl.
*G08B 23/00* (2006.01)
*G08B 21/08* (2006.01)

(52) U.S. Cl.
CPC ..... *G08B 21/086* (2013.01)

(58) Field of Classification Search
CPC ... G08B 21/086; G08B 13/184; G08B 13/183
USPC ..... 340/5.7, 541, 573.1, 552, 902, 556, 340/573.6, 940, 544, 626
See application file for complete search history.

(56) References Cited

U.S. PATENT DOCUMENTS 3,623,057 A * 11/1971 Hedin ..... G08B 13/184 250/347
4,551,713 A 11/1985 Aossey
4,620,181 A * 10/1986 Sackett ..... G08B 21/086 250/227.11
4,701,751 A * 10/1987 Sackett ..... G08B 21/086 250/221
4,780,706 A 10/1988 Bollag
4,910,498 A * 3/1990 Feher ..... G08B 21/086 250/221
4,924,214 A 5/1990 Hill
(Continued)

FOREIGN PATENT DOCUMENTS

GB 2438265 A 11/2007
GB 2452237 A 3/2009
(Continued)

OTHER PUBLICATIONS

International Search Report dated Apr. 5, 2016, issued in corresponding PCT/US2015/039947, 3 pages.
(Continued)

*Primary Examiner* — Hoi Lau
(74) *Attorney, Agent, or Firm* — Millen, White, Zelano & Branigan, P.C.; William Nixon

(57) ABSTRACT

An alarm system surrounds a pool, or other body of water, to alert a parent or other personnel of a potential drowning situation for a child. A pad borders the pool and is separated into sections. The pad encloses pressure sensors that detect when a child comes onto the pad. The different sections include different sensors. The sensors are coupled to a detector device that determines different actions to perform to alert someone of the danger situation. The actions includes an audible alarm, vibration, shock or sending an image, video or message indicating that a child is in danger.

18 Claims, 5 Drawing Sheets

(56) References Cited

U.S. PATENT DOCUMENTS 5,023,593 A * 6/1991 Brox ..... G08B 21/082 340/522
5,195,060 A * 3/1993 Roll ..... G08B 21/082 310/337
5,369,623 A * 11/1994 Zerangue ..... G08B 21/082 340/540
5,391,080 A * 2/1995 Bernacki ..... A63B 69/12 434/254
5,548,275 A * 8/1996 Shambayati ..... G08B 21/086 340/544
5,563,580 A * 10/1996 Stephens ..... G08B 21/086 340/522
5,828,626 A * 10/1998 Castile ..... G08B 21/084 340/553
5,886,630 A * 3/1999 Menoud ..... G08B 21/082 340/540
6,130,615 A * 10/2000 Poteet ..... G08B 21/086 340/539.1
6,154,140 A * 11/2000 Thorpe ..... B63C 11/02 340/573.6
6,259,365 B1 * 7/2001 Hagar ..... G08B 21/086 340/541
6,707,386 B1 3/2004 Pruisner
6,774,790 B1 * 8/2004 Houston ..... G08B 13/183 340/539.16
7,138,921 B1 * 11/2006 Fontaine ..... G08B 13/196 340/506
7,259,682 B2 8/2007 Vannerus et al.
7,436,327 B2 * 10/2008 Kaski ..... A63B 71/0605 200/52 R
7,834,769 B2 11/2010 Hinkle et al.
8,193,936 B2 * 6/2012 Houston ..... G08B 13/183 340/539.16
8,604,941 B2 12/2013 Milon et al.
2004/0218786 A1 * 11/2004 Murakoshi ..... A63B 24/0003 382/107
2006/0226994 A1 * 10/2006 So ..... A01K 15/023 340/573.3
2007/0268145 A1 * 11/2007 Bazakos ..... G07C 9/00111 340/573.1
2007/0273765 A1 * 11/2007 Wang ..... G06K 9/00771 348/152
2008/0084317 A1 * 4/2008 Gakhar ..... F16P 3/14 340/573.4
2008/0129498 A1 * 6/2008 Howarter ..... G08B 3/10 340/541
2008/0218332 A1 * 9/2008 Lyons ..... G08B 25/001 340/529
2008/0238636 A1 * 10/2008 Birging ..... B60R 25/1004 340/426.1
2008/0266118 A1 * 10/2008 Pierson ..... A61B 5/0205 340/573.6
2008/0278338 A1 11/2008 Krell
2009/0027211 A1 * 1/2009 Cutler ..... G08B 21/088 340/573.6
2009/0251321 A1 10/2009 Delorey
2009/0295566 A1 * 12/2009 Weintraub ..... G08B 21/088 340/539.11
2010/0176956 A1 * 7/2010 Moerschell ..... G08B 21/182 340/573.6
2010/0182151 A1 7/2010 Yang
2011/0043359 A1 2/2011 Toler
2011/0221605 A1 9/2011 Niemann et al.
2011/0273291 A1 * 11/2011 Adams ..... G08B 13/183 340/552
2012/0062377 A1 * 3/2012 Mock ..... G08B 21/088 340/539.11
2012/0092163 A1 * 4/2012 Hart ..... G08B 19/005 340/541
2012/0313785 A1 * 12/2012 Hanson ..... G08B 21/24 340/573.1
2013/0021136 A1 * 1/2013 Brunetti ..... G07C 9/025 340/5.7
2013/0106610 A1 5/2013 Pratt
2013/0127620 A1 * 5/2013 Siebers ..... G08B 21/02 340/573.1
2014/0306834 A1 * 10/2014 Ricci ..... B60Q 1/00 340/902
2016/0012700 A1 * 1/2016 Matko ..... G08B 21/086 340/573.6

FOREIGN PATENT DOCUMENTS

GB 2469687 A 10/2010
IE S86299 B2 11/2013
JP H03-212258 A 9/1991
WO 2004102501 A1 11/2004

OTHER PUBLICATIONS

English translation Abstract of JPH03-212258 published Sep. 17, 1991 (1 page).

* cited by examiner

ALERT SYSTEM FOR CHILDREN WITHIN PROXIMITY OF A POOL OR WATER

FIELD OF THE INVENTION

The present invention relates to systems to alert others in the event that a child wanders into proximity of a pool or water enclosed by a fence or other barrier. More particularly, the present invention relates to systems configured to alert an adult, responder or other party to intercede to prevent the child from getting closer to or falling into the pool or water.

BACKGROUND OF THE RELATED ART

One of the biggest causes of deaths in the United States for children is drowning. Even if a child does not die, serious physical harm may occur from being in water for as little as three minutes. These accidents also result in significant medical expenses. The potential harm increases as more pools and water play areas, as well as decorative ponds and fountains, are built.

Some states require fences to surround pools or enclose an area around the water. The fences usually must satisfy specific requirements in terms of height and opening dimensions. A problem may occur when a child is able to open a gate within the fence and still access the water. This action may happen when the child is unattended, or a parent/guardian is distracted. Most children can do this in a matter of seconds. Once the gate is opened, the child can fall into the water extremely quickly, and maybe drowning before the parent/guardian notices the open gate.

Known systems use alarms to provide an audible alert that a child is within the enclosed area. These alarms also may startle the child to turn back and leave the pool area. A shortcoming of these audible alarm systems is that the child may still enter the enclosed area and fall into the pool while the alarm is sounding. Further, the audible alarm may malfunction or be ignored. An alarm is ignored if the parent/guardian is constantly getting up to check the pool area when a pet knocks the gate open. Even if the parent reacts quickly, the child may open the gate and fall into the water prior to the person getting to the pool.

SUMMARY OF THE INVENTION

The present invention includes a pad that acts as a threshold to surround the base of a fence enclosed a pool. Pool, as used hereinafter, also includes water hazards of any type, fountains, ponds, decorative water fixtures, and the like that can result in the drowning or partial drowning of a child. It also may refer to those bodies of water that can result in the drowning of an adult. Preferably, the fence serves to keep people, children, pets and the like from accessing the pool except through a gate or entryway. A fence, however, is not required.

Although the term child is used in the below specification, the disclosed embodiments include an alert system for any human that may be harmed by falling into water. Child is used hereinafter to include anyone that should not be near a pool due to handicap, injury, age, and the like.

The pad includes pressure sensors that detect when a child walks or crawls onto the pad. Thus, the pad serves as a threshold detection device to alert the parent that the child is within the vicinity of the pool. When the appropriate level of pressure is detected, an audible alarm may sound. Further, the pad may vibrate to prompt the child to get off the pad.

In another embodiment, a small shock signal may flow through the pad to deter the child from going further onto the pad.

Should the child continue to advance towards the pool, the pad will detect the continued pressure using the sensors. In one embodiment, a second group of sensors closer to the fence or pool may be used to detect when the child crosses a threshold closer to the pool. At this point, noise, vibration or shock may not be enough deterrent to the child. Thus, a signal is sent to a camera located nearby to provide an image of the pool. Alternatively, a set of cameras may be set up around the pool and the camera closest to the detected pressure may activate upon receipt of the signal. The images captured by the camera are sent to the phone or other device of the parent/guardian. Further, images may be sent to a response unit, such as police, fire/rescue, an alarm monitoring service, and the like. By providing visual confirmation that a trouble situation is imminent, someone may react in a timely manner to prevent the child from falling into the pool.

The disclosed embodiments also may include an application on a smart device, such as a smartphone, tablet or a smart television, which receives the signal. Preferably, the signal is tuned to the smart device, or may be a push data packet from the detector device to the smart device. The application may be loaded onto the smart device along with the alert system setup. The application and detection device are synced to exchange data. For example, a parent may set parameters for the alert system using the application.

In another embodiment, children near the pool may wear bracelets or other devices to provide immediate alerts that they are near the pool or in danger. This feature may be desirable when many children are near the pool, such as a party, and the normal alarm features are turned off. When a child with the bracelet crosses a boundary, the camera is activated and signals sent to the appropriate adults and devices. The boundaries may be set along the pool's edge or with the alert system pad.

Thus, an alert system surrounding a pool or body of water is disclosed. The alert system includes at least one pad adjacent a boundary proximate the pool or body of water. The alert system also includes a plurality of pressure sensors within the at least one pad. The plurality of pressure sensors is configured to detect the presence of a child. The alert system also includes a detector device coupled to the plurality of pressure sensors to determine the presence of the child. The alert system also includes an alarm device coupled to the detector device to provide an alarm when instructed by the detector device. The alert system also includes a transmitter coupled to the detector device that activates a signal when instructed. The alert system also includes a camera configured to capture an image or images upon receipt of the signal of an area near the pool or body of water.

Further, a method for alerting of a drowning situation for a child near a pool or body of water is disclosed. The method includes detecting a presence of a child using a pad enclosing pressure sensors. The pad surrounds the pool or body of water. The method also includes activating an alarm due to the presence of the child. The method also includes sending a signal to a camera due to the detected pressure. The method also includes capturing an image of an area of the pad detecting the pressure of the child.

Further, an alert system for a pool or body of water to detect the presence of child is disclosed. The alert system includes a waterproof pad. The alert system also includes a plurality of pressure sensors enclosed by the waterproof pad. The plurality of pressure sensors comprise at least two sets of sensors. A first set of sensors is closest to the pool or body of water. The alert system also includes a detector device coupled to the plurality of pressure sensors to receive an indication that pressure is detected within one of the sets of sensors and to perform an action to alert of a danger situation. The alert system also includes a plurality of vibration bars to vibrate the waterproof pad in response to the detector device. The alert system also includes a plurality of wires to provide a shock within the vicinity of the one of the sets of sensors. The alert system also includes a transmitter to transmit a signal for the detector device. The alert system also includes a camera responsive to the signal to capture an image of an area detecting the indication of pressure by the one of the set of sensors.

BRIEF DESCRIPTION OF THE DRAWINGS

The accompanying drawings are included to provide further understanding of the disclosed embodiments and constitute a part of the specification. The drawings listed below illustrate embodiments of the claimed invention and, together with the description, serve to explain the principles of the invention, as disclosed by the claims and their equivalents.

DESCRIPTION OF THE PREFERRED EMBODIMENTS

Figure 1:
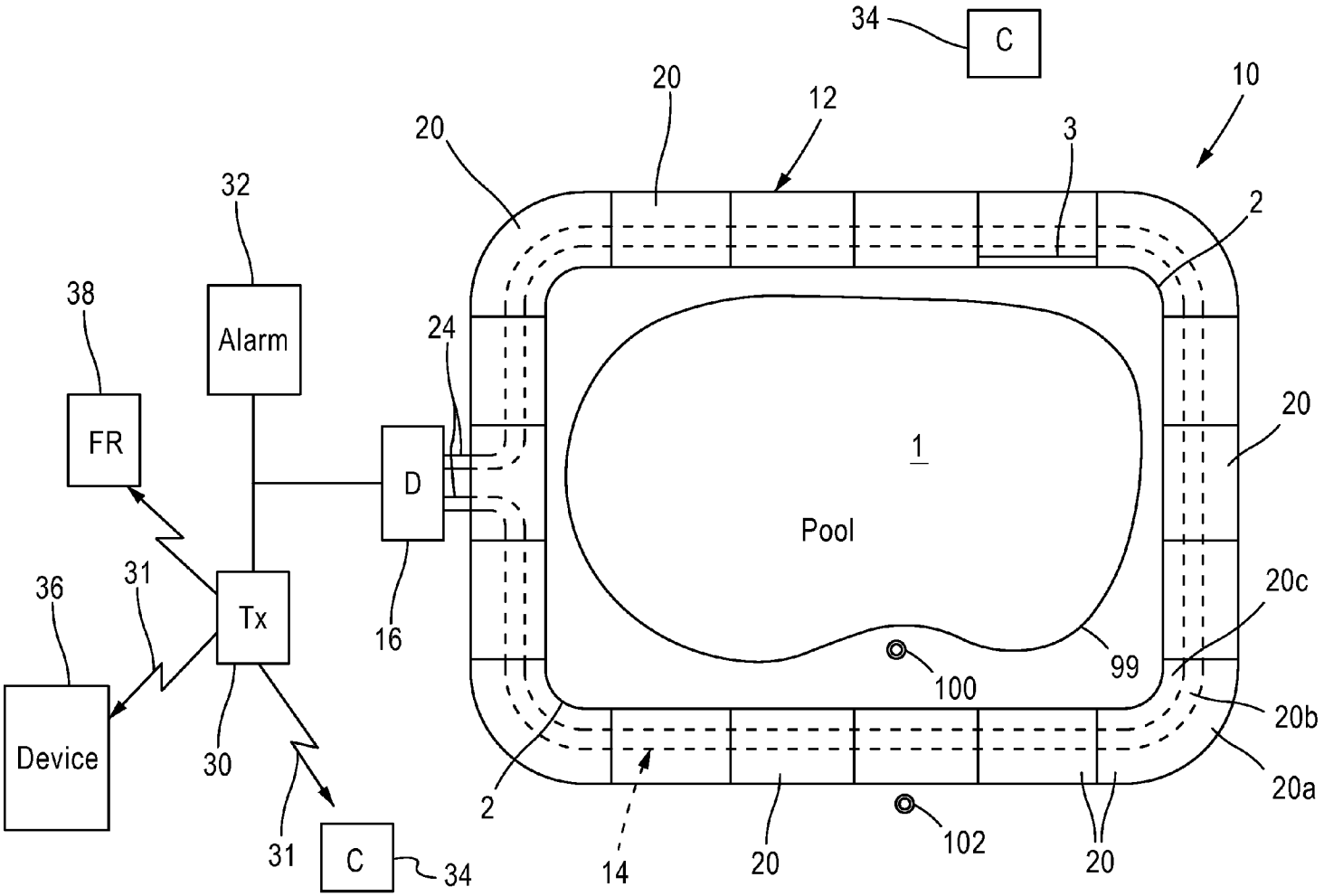
FIG. 1 illustrates an alert system for a pool according to the disclosed embodiments.

Aspects of the invention are disclosed in the accompanying description. Alternate embodiments of the present invention and their equivalents are illustrated without parting from the spirit or scope of the present invention. It should be noted that like elements disclosed below are indicated by like reference numerals and the drawings.

FIG. 1 depicts an alert system 10 for a pool 1 according to the disclosed embodiments. Pool 1 is surrounded by fence 2. Preferably, fence 2 is of a height and width to prevent a child from entering an area surround pool 1. Fence 2 also includes a gate 3 that allows access to pool 1. Gate 3 is opened or closed. Additional gates may be included around pool 1, and the number is not limited to one gate. Gate 3 may have a lock on it to prevent unauthorized entry, though such a feature is not required for alert system 10.

A plurality of threshold pads 20 surround fence 2 to provide information to detector device 16. Pad 20 is laid out at the base of fence 2. Pads 20 may be separate components or one large pad. The entire assembly will be referred to as pad 20 hereinafter. In an embodiment, pad 20 is attached to a pre-existing fence 2 as a unitary assembly. In other embodiments, pad 20 is sold separately and attached to fence 2.

Preferably, pad 20 is comprised of waterproof material such that it may be used while pool 1 is occupied. Pad 20 may be covered by the waterproof material. In some embodiments, the waterproof material is a fabric. The waterproof fabrics are usually natural or synthetic fabrics that are laminated to or coated with a waterproofing material such as rubber, polyvinyl chloride (PVC), polyurethane (PU), silicone elastomer, fluoropolymers, and wax. In other embodiments, the waterproof material may be rubber or plastic. Waterproof fabric may be preferred as it will allow the sensors to detect pressure. People walking to and from pool 1 should not damage pad 20.

Pad 20 extends away from fence 2. Edge 12 of pad 20 may lie on ground or another surface. Preferably, the width of pad 20 is about 2 to 2.5 feet. Thickness of pad 20 may vary but should be enough to provide a boundary visually to someone. In other words, the pad can deter a child by just being seen. In addition, one should have to step on pad 20 to enter pool 1. Pad 20 should not be hidden or blended into the area surrounding fence 2. In some embodiments, pad 20 is about 2-3 inches thick, which provides notice that one is stepping off the grass, concrete, dirt, sand and the like at ground level.

Sensors 24 are implanted into pad 20. Preferably, sensors 24 are pressure sensors to detect when an object or item of a certain weight is on pad 20. Sensors 24 may include pressure transducers, pressure transmitters, pressure senders, pressure indicators, piezometers and manometers. This configuration is disclosed in greater detail below. Each section of pad 20 may be broken into further sections to detect how far the child has gone onto pad 20. Thus, section 20*a* may be that part of pad 20 closest to the edge 12 and furthest from fence 2. Section 20*b* is closer to fence 2, and sensors within this section may activate more severe deterrent measures. Section 20*c* is against fence 2. If the child reaches section 20*c*, then severe deterrent measures are activated as well as alert actions.

Detector device 16 is electronically coupled to sensors 24 within pad 20. Detector device 16 includes a processor and memory to execute the functions needed to alert a parent that a child is on pad 20. Detector device 16 also may include functionality to set alarm parameters, such as the amount of pressure needed to activate the sensors. This feature allows one to prevent false alarms by pets or small animals. Detector device 16 also may allow the parent to set countdown features so that a period of time passes when pressure is detected on section 20*a* before activating any alerts.

Detector device 16 is coupled to alarm device 32. When pressure is detected on pad 20, detector device 16 may enable alarm device 32 to sound an audible alarm. Alarm device 32 also may include visual alarms, such as a flashing light or lights to deter the child as well as letting the parent know that a dangerous situation is occurring. Alarm device 32 may be coupled to detector device 16 by a wired or wireless connection. Alternatively, alarm device 32 may be integrated with detector device 16.

Alarm device 32 also may activate other deterrent measures to prevent a child from proceeding closer to pool 1. Such actions may include vibrating pad 20. The child may sense the vibration and run away from pad 20. A mild shock may flow through pad 20 to scare the child as well, with the amount of shock increasing as within sections 20*a-c*. The purpose of these measures is to cause the child to not want to proceed on pad 20. A loud alarm noise may not be enough to scare the child to stay off pad 20 and away from pool 1. The vibration and shock measures may do the trick. These configurations may require that alarm device 32 be coupled directly with pad 20, and sensors 20*a*, 20*b* and 20*c*.

Some children, however, still may not be deterred, or may run towards pool 1 when frightened. Moreover, the parent may not hear the audible alarm in time, and is not aware that pad 20 is vibrating or subject to a shock. Thus, system 10 also includes transmitter 30 coupled to detector device 16. When activated by detector device 16, transmitter 30 sends a signal, or a series of signals, 31. These signals may go to a device 36, such as a smartphone, being held by the parent. There may be multiple devices 36 enabled to receive signals 31. A signal also may be sent to first responder 38. First responder 38 may refer to an emergency contact, such as 911 or other means for responding to an emergency. The signal also may activate additional alarms.

Signals 31 also activate camera 34. Camera 34 may be placed to cover an area surrounding pool 1. Upon receipt of the signal, camera 34 turns on and starts capturing images of the area surrounding pool 1. These images may then be transmitted to the device 36 so that they can see immediately that the child is in danger. Further, the images may be sent over a wireless or wired network to first responder 38, such as the police or fire rescue, that an emergency is occurring near pool 1. "First responder" may refer to anyone tasked with responding to emergency situations. As well as 911/fire/police, first responder may refer to lifeguards, monitors, park personnel or anyone else responsible for the safety of others. Using the disclosed embodiments, the first responder can view the images and determine whether a situation exists that could result in the drowning of a child.

In some embodiments, the pushing of the picture over the network to device 36 and first responder 38 may be done via SMS messaging, text message, and the like. Alternatively, an email may be sent to an email account or plurality of accounts stored by detector device 16. Emails are not as timely as messaging applications. Other alerts may be enabled to receive signals 31.

More than one camera 34 may be used. Referring to FIG. 1, one camera may cover the lower side of pool 1, while another camera covers the upper side. Further, detector device 16 may determine where the pressure sensors 24 detected the pressure to activate the proper camera to use. For a large pool, one camera may not be enough to provide proper coverage of small children near fence 2 or pool 1. Thus, multiple cameras 34 are used in specific locations. For example, if there is a kiddie area of a pool, then a dedicated camera 34 may be used to cover that area, though it is small.

The use of the cameras provides greater functionality than known alarm systems. An audible alarm may be ignored or not heard if the parent is inside or just not able to hear it (being in shower, watching television, listening to music, etc.). As noted above, the parent may not be aware of vibrating pad 20 or sending a shock signal. Moreover, many drowning accidents occur in the presence of a large group of people because someone assumes that someone else is watching the children. Loud noises just may not be enough to alert one to a drowning situation.

The disclosed embodiments provide images to the parent through device 36 or a first responder (shown as first responder 38) that the child is about to go into pool 1. They can visually determine the level of potential harm and react accordingly. One does not have to waste time calling the first responder either. It only takes three (3) minutes for a child to drown, and children under water for any length of time will need CPR within ten (10) minutes of rescue. The disclosed embodiments reduce the response time needed to address a drowning situation. Like most text messages, an image or alert may be received quickly. Thus, every second counts, and these seconds may be saved using the disclosed embodiments. If a network is down or messaging services are not available, alert system 10 may still perform by sounding alarm 32.

In other embodiments, system 10 may use tracking devices 100 and 102 to monitor children or adults within the vicinity of pool 1 without necessarily tripping alarms using pad 20. Tracking devices 100 and 102 may be a bracelet, anklet, necklace, wrist band and the like with a sensor or chip that is detectable by system 10. Tracking devices 100 and 102 may incorporate RFID technology, and include an antenna to respond to queries or requests for position. Detector device 16 may check the locations of tracking devices 100 and 102 on a periodic basis. When someone wearing a tracking device crosses a boundary, system 10 automatically alerts parents or responders that a situation is occurring.

For example, a boundary may be set for pad edge 12 shown in FIG. 1. Tracking device 102 is worn by a child. The child may be a non-swimmer so that any entrance into pool 1 without immediate adult supervision will result in drowning. If the child crosses pad edge 12, then system 10 will alert the parents or other adults as disclosed by the embodiments herein.

Another boundary may be set at pool edge 99. This boundary would provide immediate notification if a child falls into the pool. Referring to FIG. 1, a child wearing tracking device 100 would be allowed within the area surrounding pool 1, but not allowed into the pool itself. The child also may cross over pad 20 without causing alarms and alerts as disclosed herein. This feature prevents unnecessary setting off of system 10 but also provides functionality to still alert parents and responder if a drowning situation occurs.

These features may be desirable if there is a party using pool 1 with many children and adults nearby. Children will try to get into the area enclosed by fence 2 to be with their parents, friends, etc. Pad 20 does not want to sound alarm device 32 every time someone walks across it, so it may be turned off. Certain children or even adults, however, may not be allowed within the boundaries set by edges 12 and 99. Tracking devices 100 and 102 prevent that from happening.

Figure 2:
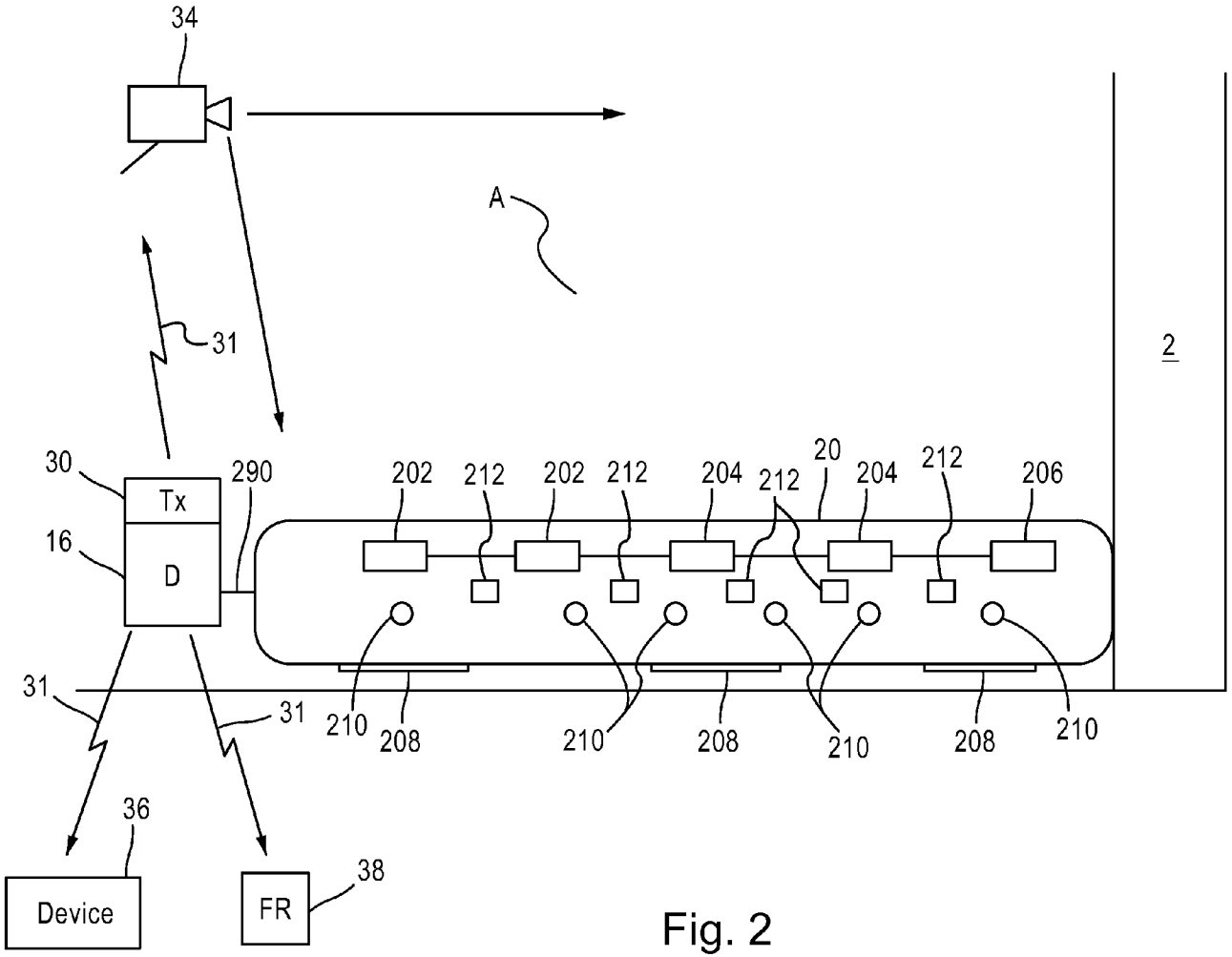
FIG. 2 illustrates the threshold pad according to the disclosed embodiments.

FIG. 2 depicts the threshold pad 20 according to the disclosed embodiments. Pad 20 is pressed or pushed against fence 2. Detector device 16 is electrically coupled to components within pad 20. Transmitter 30 is shown within device 16. Device 16, alarm device 32 and transmitter 30 may be housed within one device, though shown separately in FIG. 1. Preferably, detector device 16 is connected to pad 20 via a wire or cable 290. Detector device 16 may communicate with pad 20 via a wireless connection, but the wired or hard connection is preferred to still have alert system 10 operate in the absence of a wireless network.

Pad 20 encloses sensors 202, 204 and 206. Sensors 202, 204 and 206 may correspond to sensors 24 in FIG. 1. Sensors 202, 204 and 206 differ in that they are located in different sections 20*a-c* of pad 20. Sensors 202 may detect pressure from a child as he/she comes onto pad 20, as shown by section 20*a*. Sensors 204 may detect pressure from the child as he/she moves closer to fence 2, as shown by section 20*b*. Sensors 204 may activate greater deterrence measures, such as shocks or vibrations within pad 20. Sensors 206 detect pressure from the child as he/she is right against fence 2, as shown by section 20*c*.

Pad 20 includes adhesive patches 208 to secure the pad to a surface. Adhesive pads 208 are located on the bottom or underneath pad 20. For example, a concrete walkway may surround fence 2. Patches 208 keep pad 20 in place on the concrete surface in front of fence 20. Alternatively, alarm system 100 may use hooks, spikes or other means to secure pad 20 to a surface. If located in a yard, pad 20 may use anchors spaced along the perimeter of pad 20 to keep it in place by driving into the ground. The anchors are attached to pad 20. Preferably, pad 20 is not permanently secured to a surface to allow removal of pad 20.

Pad 20 also includes wires 210 to deliver the shock signal to scare the child. An amount of current or voltage may be applied to wires 210 to produce the shock to one touching pad 20. The amount of current or voltage may be modified so that the doses are non-lethal to the child. For pets or adults, the amount of shock may be greater. Alternatively, the current flowing through wires 210 may result in heat being felt on pad 20.

Vibration bars 212 also may reside in pad 20 so that the pad moves when bars 212 are activated. Bars 212 may shake to produce a vibration sensation to one standing on pad 20. Power is received at vibration bars 212 to activate them. Preferably wires 210 and bars 212 are enclosed by padding so that these items are not damaged when pad 20 is stepped upon. Wires 210 and vibration bars 212 also are coupled to detector device 16. Detector device 16 may include circuitry to activate the functions of wires 210 and vibration bars 212.

Using the configuration shown, pressure upon sensors 204 may activate transmitter 30 to send signal 31. Preferably, transmitter 30 sends signals to different components via a wireless network. The wireless network may be configured to operate in infrastructure mode but transmitter 30 also could be part of an ad-hoc network. Transmitter 30 may operate according to known wireless communication protocols, such as long term evolution (LTE), Wi-Fi, WPA2, Bluetooth, WirelessHD, WiGig, Z-wave, Zigbee and the like. Transmitter 30 may communicate with a broadband router to relay signals and commands from detector device 16 to other components connected to the network. Transmitter 30 includes an antenna to perform these operations.

Alternatively, transmitter 30 may be connected to the various components, such as camera 34, with a wire or cable. In other embodiments, detector device 16 may be coupled to transmitter 30 with a wire and the transmitter is located a small distance from pool 1. According to this example, pool 1 is not located in a spot that is not capable of receiving and sending wireless signals. Transmitter 30 is located inside a house or building, possibly along with alarm 32, and connected to detector device 16 by a wire. If sensors 202-206 detect a potential drowning scenario, then transmitter 30 sends signals from within the house or building to the appropriate components. Further, alarm 32 may sound within the building or house.

As shown in FIG. 2, transmitter 30 sends signal 31 to camera 34. Camera 34 then may take a picture (preferably digital) or a video of area A encompassing the location of the activated sensor 204. The picture or video should capture the location of the child on pad 20. Alternatively, for a small area, camera 34 may capture images or video of the entire area of pad 20. The captured image or video may be sent to device 36 over the network to alert an adult or caretaker of the situation. Further, alarm 32 may be activated to provide noise, vibrations or small shocks to alert the child and anyone in the vicinity of pool 1.

Pressure upon sensors 206 may cause signal 31 be sent to first responder 38 so that person may arrive at pool 1 to prevent the child from drowning. Sensors 206 also may sound a higher pitched audible alarm from alarm 32. Alarm 32 or detector device 16 also may provide a greater current for shocking the child through wires 210, or heavier vibrations through vibration bars 212. In short, pressure on sensors 206 cause a higher level of alert and contacts parties to make sure the child does not fall into pool 1.

Figure 3:
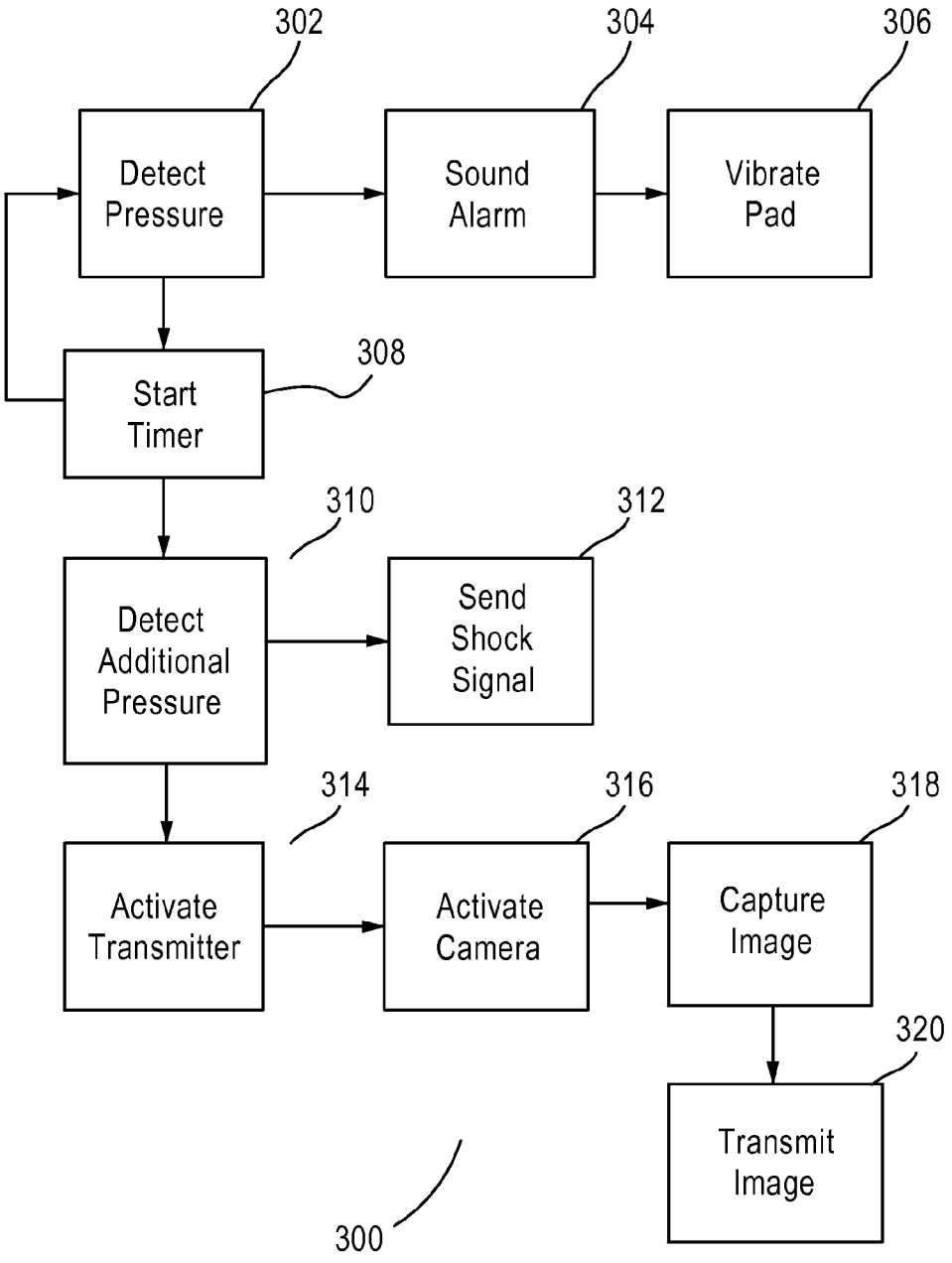
FIG. 3 illustrates a flowchart for alerting a device with a potential drowning situation according to the disclosed embodiments.

FIG. 3 depicts a flowchart 300 for alerting a device with a potential drowning situation according to the disclosed embodiments. Step 302 executes by detecting pressure using the sensors within pad 20. Step 304 executes by sounding an alarm attached to pad 20. The alarm may reside within alarm device 32. The alarm makes an audible alert to people within the vicinity of pool 1. Step 306 executes by vibrating pad 20 using bars 212, for example, to possibly scare the child from proceeding further towards the pool.

Step 308 executes by starting a timer within detector device 16. The timer may count down the period that pressure is detected by the sensors. This means that additional measures may be taken after the period ends. If the child stands on pad 20, but does not move away from pool 1, then the additional measures may be taken, as disclosed below. Should the child activate the sensors closer to pool 1, such as sensors 204 or 206, then the timer stops and the additional measures immediately are taken.

Step 310 executes by detecting additional pressure on pad 20. Preferably, this is done by determining that the child has moved towards pool 1 using the sensors 204 or 206 in sections 20*b* or 20*c*. Step 312 executes by sending a shock signal in pad 20 to scare the child off the pad.

Step 314 executes by activating transmitter 30 because the chance of drowning increased by the time period expiring or the additional pressure closer to pool 1. Transmitter 30 sends signal 31 to various components on the network. Preferably, as disclosed above, the signals may be sent over a wireless network. Step 316 executes by activating camera 34. Camera 34 turns on using logic within the camera. A receiver may receive signal 31 and then switches on camera 34. Step 318 executes by capturing images using camera 34 of an area near pool 1. Hopefully, the images include the child so that a parent or responder can determine whether an emergency situation exits. Step 320 executes by transmitting the images to a device or to a responder station.

The functions disclosed above also may executed in conjunction with an application on a smart device, such as a smart phone, table or smart television. The images captured by camera 34 may be sent to the device using the application. A parent synchronizes the application with system 10 to provide the functionality needed to prevent drowning. The application also may be used to set parameters within system 10, and to turn the alert features on and off. The application also may immediately connect the parent with a responder to coordinate rescue or preventive measures.

Statistics show that if someone is under water for three (3) minutes, then that person may suffer brain damage, or become brain dead, if not dead. Even if that person is pulled out of the water and still alive, then he/she would need CPR within 10 minutes to prevent permanent or lethal damage. Further, children may suffer from "secondary drowning" after ingesting large amounts of water or being within a pool without proper supervision.

Conventional alarms sound alarms or make noise. These systems, however, may not be effective if the parent cannot hear the alarms, or is inside or away. Further, the parent may not even be home or aware the child is near a pool. The child might have run away from his/her yard and went to a neighbor's pool. The alarm sounding would not concern the child's parents because they don't own a pool. Thus, the disclosed embodiments provide additional features in turning on a camera, sending signals to devices and provide immediate visual confirmation that a situation is at hand, and needs immediate response.

Other systems seek to keep animals or pets away from enclosed areas. These systems are not necessarily applicable to a system to prevent drowning situations of children. A parent can see that a pet is on the pad and activating the pressure sensors, and that immediate attention is not required. The sight of a child, however, would allow the parent to react immediately.

Once the situation is determined, the disclosed system will connect to a network, such as the internet, to an application on a device, videoconferencing application or to a responder with images captured by a camera to give a view of the situation. Other metadata associated with the capture images, such as GPS location, time stamps, and the like also may be transmitted. Conventional pool alarm systems do not provide this functionality.

Figure 4:
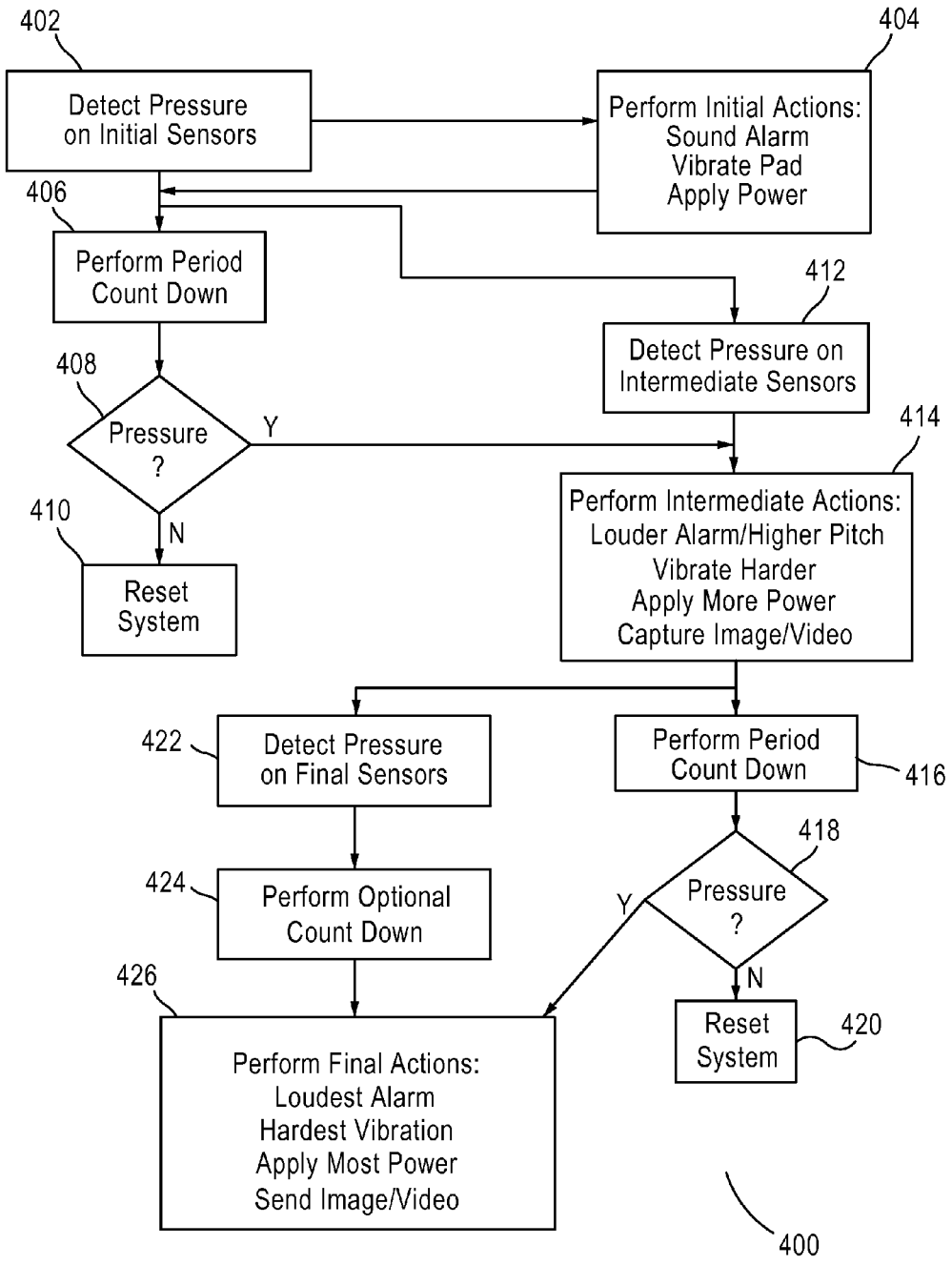
FIG. 4 depicts a flowchart of performing alert actions when a child is detected by the alarm system according to the disclosed embodiments.

FIG. 4 depicts a flowchart 400 of performing alert actions when a child is detected by alarm system 10 according to the disclosed embodiments. Flowchart 400 may complement flowchart 300 as it provide more detail that the steps shown in FIG. 3. Flowchart 300, however, is not limited by the embodiments disclosed by flowchart 400.

Step 402 executes by detecting pressure on the initial sensors within pad 20. According to the disclosed embodiments, the initial sensors are sensors 202. Sensors 202 may be set to determine an appropriate weight to detect problems so as to not cause false alarms with debris falling on pad 20. Step 404 executes by performing initial actions related to a child being on the outside area, such as section 20*a*, of pad 20. These initial actions are disclosed above, and include sounding alarm device 32, vibrating pad 20 using vibration bars 212, and providing power or current to apply a mild level of shock to section 20*a* through wires 210.

Flowchart 400 then may move to step 406, which executes by performing a period count down. Detector device 16 may activate a timer to count down a period set by a parent, operator, or manufacturer to determine whether to take additional steps to prevent the child from proceeding towards pool 1 and possible harm. The period of time may be 20 seconds, 1 minute, 5 minutes and the like. Preferably, this period is no more than 3 minutes as that is the period of time that a drowning child may suffer brain damage.

Step 408 executes by determining whether pressure is still detected on the initial sensors after the period expires. If no, or if it can be determined the child is off the pad, then step 410 executes by resetting alarm system 10. This step may involve turning off alarm device 32, vibration bars 212 and removing power or current from flowing through wires 210. Alternatively, the stoppage of the actions taken in step 404 may occur after a user manually resets the system. If step 408 is yes, then pressure is detected, which indicates that child is still on pad 20. Flowchart 400 goes to step 414.

In addition to steps 406-410, the disclosed process may go directly to step 412. Step 412 executes by detecting pressure on the intermediate sensors, such as sensors 204 in pad 20. The intermediate sensors are located in section 20*b* of pad 20. Pressure on these sensors indicates that the child has moved closer to pool 1, and, therefore, is in greater danger. Step 412 pre-empts the countdown process of step 406 and activates as soon as pressure is detected on the intermediate sensors.

Step 414 executes by performing intermediate actions by alarm system 10 to further alert someone that the child is in danger. These actions include making emitting a louder or higher-pitched alarm from alarm device 32, harder vibrations using vibration bars 212, or applying more power or current through wires 210 to provide a more severe shock to the child. Preferably, the child will move back towards section 20*a* and off pad 20. Step 414 also may execute by capturing an image, or plurality of images, or video of the child on pad 20.

Step 416 executes by performing the period count down, as disclosed by step 406. This period may differ from the period used in step 406, such as being shorter because harm is more imminent. Step 418 executes by determining whether pressure is still applied to the intermediate sensors. If no, then step 420 executes by resetting alarm system 10, similar to step 410. If step 418 is yes, then flowchart 400 moves to step 426.

After step 414, the disclosed process may move to step 422. Step 422 executes by detecting pressure on the final sensors, such as sensors 206 in section 20*c* of pad 20. Because the child is closer to pool 1, more advanced measures are taken to alert someone that the child is in immediate danger. Step 422 pre-empts the countdown process of step 416 and activates as soon as pressure is detected on the final sensors.

Step 424 may be an optional step that executes by performing the countdown process disclosed in steps 406-410 and 416-420. Any countdown period for step 424 is preferably shorter than the other count down periods, maybe as little as 10 seconds, to determine if pressure is still detected on the final sensors. Step 424 is optional because the disclosed embodiments may want to proceed immediately to step 426 once pressure is detected.

Step 426 executes by performing the final actions to alert someone that a child is in danger. The final actions include having alarm device 32 emit an alarm on its loudest setting or highest pitch. The higher pitch will annoy one to take action and is not ignorable like a plain sound alarm. Further, detector device 16 may vibrate at the highest level to make it hard to walk on pad 20. The highest level of power or current may be applied to wires 210 to shock the child should he or she remain in section 20*c* close to pool 1.

Step 426 also may send the image, images or video captured in step 414 to a parent, guardian, caretaker, lifeguard and the like. The captured information also may be sent to a first responder or a 911 service to alert personnel that the child is in immediate danger. A text or message also may be sent. Alternatively, the sending of such information may occur in step 414 after the data is captured.

Flowchart 400 disclosed three sections of pad 20 and three different levels of actions that may be taken as a child approaches pool 1. Any number of iterations for the actions may be implemented, with appropriate measures and count downs. For example, five different groups of sensors may be configured in five different sections to provide escalating levels of actions to prevent the child from getting into pool 1. The different groups may have different count down periods, different sounding or levels of alarms, and so on. Further, at any time, images and videos may be captured and sent over the network by the disclosed embodiments.

Figure 5:
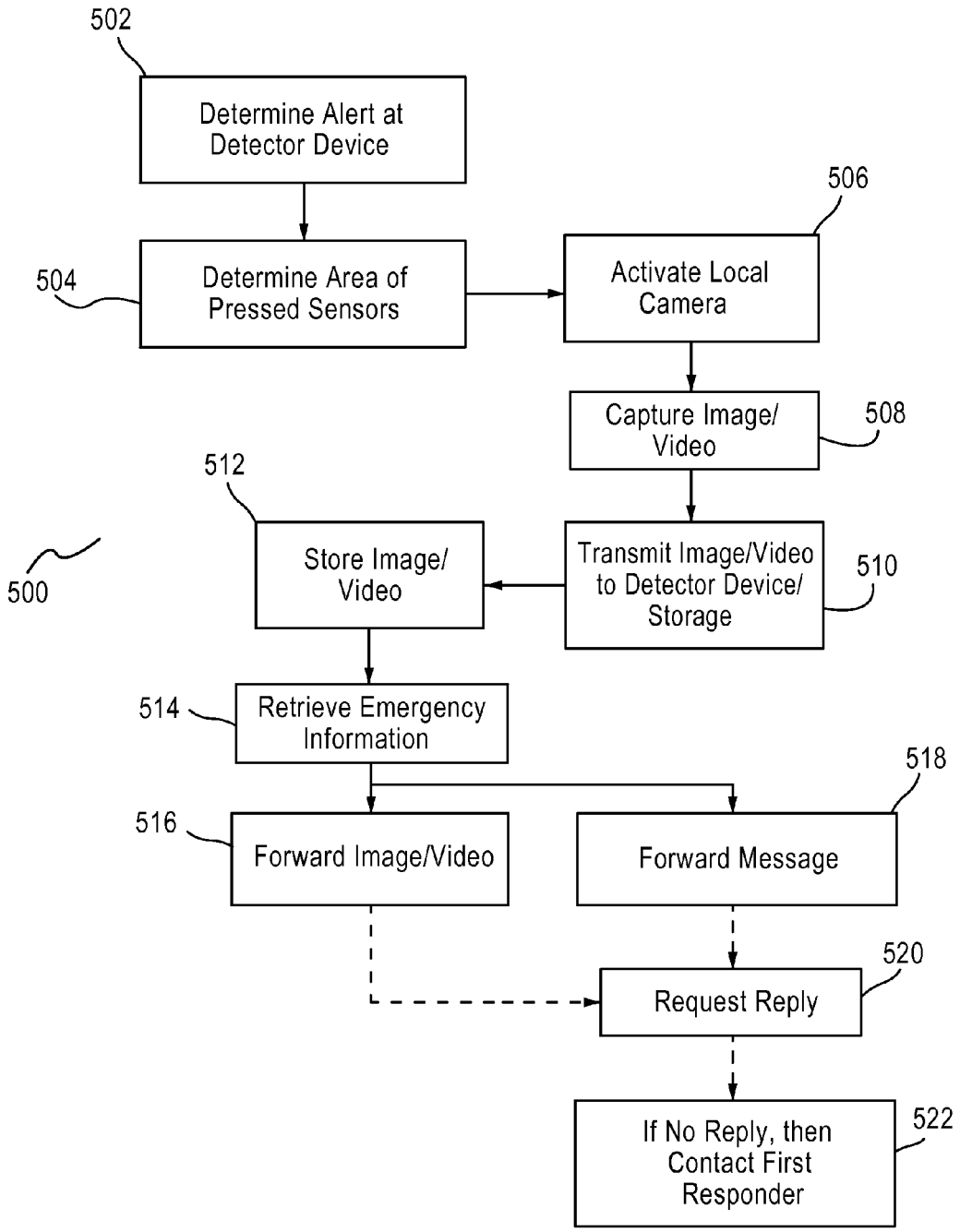
FIG. 5 depicts a flowchart for capturing and sending an image or video using the alarm system according to the disclosed embodiments.

FIG. 5 depicts a flowchart 500 for capturing and sending an image or video using alarm system 10 according to the disclosed embodiments. Flowchart 500 may correspond to steps taken in flowcharts 300 and 400, but do not limit the embodiments disclosed therein.

Step 502 executes by determining an alert condition exists using detector device 16. Detector device 16, using sensors, determines that an image or video is to be captured to send to the appropriate parties. Referring to flowchart 400, such action may occur in steps 404, 414 or 426 once a child is detected on pad 20.

Step 504 executes by determining where the child is on pad 20 by the pressed sensors. An area of sensors should detect pressure within a section of pad 20. Detector device 16 can provide that information. Step 506 executes by activating a camera in the area determined by the pressed sensors. If alarm system 10 includes multiple cameras, then the closest one to the location of the child may turn on. If only one camera is available for the entire area of pad 20 (and pool 1), then that camera is activated.

Step 508 executes by capturing an image or video of the child on pad 20. Preferably, the image or video is in a digital format for storage and transmission. In some embodiments, step 510 executes by transmitting the image or video from the camera, such as camera 34, to detector device 16 or a storage device. Step 512 executes by storing the image or video in a memory. This storage or memory may be located in detector device 16.

Step 514 executes by retrieving emergency contact information for the child. Such information also may be stored in detector device 16. The information may be entered when alarm system 10 is set up and a wireless or wired connection established between all the components within the alarm system. The emergency contact information may include mobile phone numbers for parents, guardians, grandparents, and the like. It also may include IP addresses for emails or websites of emergency contacts. It also may include information for local first responders, such as fire, police, lifeguards and the like. The contact information for the local 911 service may be included.

Step 516 executes by forwarding the image or video to devices or IP addresses associated with the emergency contact information. In FIGS. 1 and 2, these are shown as device 36. The image or video shows the child on pad 20. Thus, someone sees that the child is in danger of entering pool 1. At the same time, step 518 may execute by forwarding a preset message with a location for the child. The message may be sent like a text message, and does not need a wireless connection. The message may be preset with an address, contact information, and medical information to help the first responders. In some embodiments, steps 516 and 518 are not executed simultaneously, or one step may be executed and not the other.

In some alternate embodiments, step 520 executes by requesting a reply from the recipients of the image, video or message that they acknowledge receipt and that someone is responding to the situation. For example, a parent may reply back with YES or OK to indicate that she is going to help the child. Step 522 executes by executing, if no reply, then contacting first responders if that action was not taken in steps 516 or 518. Thus, the disclosed embodiments may implement escalating levels of alerts for sending images, videos or messages. If the parent does not acknowledge receiving the initial alerts then the police or fire/rescue are contacted. The levels of alert may prevent unnecessary use of emergency resources.

In other embodiments, the video may be streamed directly to a device 36. A window may open on one's computer or smart device to show streaming video of the situation.

It will be apparent to those skilled in the art that various modifications and variations can be made in the disclosed alert system for a pool without departing from the spirit or scope of the invention. Thus, it is intended that the present invention covers these modifications and variations disclosed above provided that such modifications and variations come within the scope of any claims and their equivalents.

The invention claimed is:

1. An alert system surrounding a pool or body of water, the alert system comprising:

at least one pad adjacent a boundary proximate the pool or body of water;

a plurality of pressure sensors within the at least one pad, where the plurality of pressure sensors is configured to detect a presence of a child;

a detector device coupled to the plurality of pressure sensors to determine the presence of the child;

an alarm device coupled to the detector device to provide an alarm when instructed by the detector device;

a transmitter coupled to the detector device that activates a signal when instructed; and a camera configured to capture an image or images upon receipt of the signal of an area near the pool or body of water, wherein the plurality of pressure sensors includes at least two sets of sensors, wherein a first set of the at least two sets is within a section of the at least one pad furthest from the boundary and a second set is within a section of the at least one pad closest to the boundary, and wherein the detector device performs a different alarm action for the first set as compared to the second set.

2. The alert system of claim 1, further comprising wires within the at least one pad to deliver a shock sensation when instructed by the detector device.

3. The alert system of claim 1, further comprising bars within the at least one pad to vibrate the at least one pad.

4. The alert system of claim 1, wherein the transmitter sends data over a network to a device including the captured image.

5. The alert system of claim 1, further comprising a waterproof cover for the at least one pad.

6. The alert system of claim 1, wherein the alarm device produces a visual or an audible alarm.

7. The alert system of claim 1, wherein the second set of sensors causes the signal to be sent to the camera.

8. A method for alerting of a drowning situation for a child near a pool or a body of water, the method comprising:

detecting a presence of a child using a pad enclosing at least two sets of pressure sensors, wherein the pad surrounds the pool or body of water, wherein a first set of the at least two sets is within a section of the pad furthest from the pool or body of water and a second set is within a section of the pad closest to the pool or body of water;

activating an alarm due to the presence of the child, wherein the alarm performs separate alarm actions for the first set of pressure sensors as compared to the second set of pressure sensors;

sending a signal to a camera due to the detected pressure; and capturing an image of an area of the pad detecting the presence of the child.

9. The method of claim 8, further comprising determining the area to capture the image of the child.

10. The method of claim 8, wherein the detecting step includes detecting the presence of the child using the first set or the second set of the pressure sensors.

11. The method of claim 10, wherein the detecting step includes detecting the presence of the child using the first set of pressure sensors farthest from the pool.

12. The method of claim 8, further comprising transmitting the image to a device.

13. The method of claim 8, further comprising transmitting a message to a device, wherein the message includes information pertaining to a location of the pool or body of water.

14. The method of claim 8, further comprising vibrating the pad.

15. An alert system for a pool or body of water to detect the presence of a child, the alarm system comprising:

a waterproof pad;

a plurality of pressure sensors enclosed by the waterproof pad, the plurality of pressure sensors comprising at least two sets of sensors, wherein a first set of sensors is furthest from the pool or body of water and a second set of sensors is located closest to the pool or body of water;

a detector device coupled to the plurality of pressure sensors to receive an indication that pressure is detected within one of the sets of sensors and to perform different alarm actions for each set of sensors to alert of a danger situation;

a plurality of vibration bars to vibrate the waterproof pad in response to the detector device;

a plurality of wires to provide a shock within the vicinity of the one of the sets of sensors;

a transmitter to transmit a signal for the detector device; and a camera responsive to the signal to capture an image of an area detecting the indication of pressure by the one of the set of sensors.

16. The method of claim 8, wherein activating the alarm includes performing an alarm action of sounding an audible alarm.

17. The method of claim 16, wherein sounding the audible alarm differs from the first set of sensors to the second set of sensors, in which the audible alarm is louder from the second set of sensors.

18. The method of claim 8, further comprising storing the image of the area of the pad taken by the capturing step.

* * * * *